United States Patent [19]

Kempf

[11] Patent Number: 4,789,101

[45] Date of Patent: Dec. 6, 1988

[54] WATER-DRIVEN OSCILLATING MONITOR

[75] Inventor: D. Dale Kempf, San Jose, Calif.

[73] Assignee: Spectrum Manufacturing Company, Inc., Oakland, Calif.

[21] Appl. No.: 21,841

[22] Filed: Mar. 4, 1987

[51] Int. Cl.[4] ..... B05B 3/16; B05B 15/10; B05B 3/00

[52] U.S. Cl. ..... 239/242; 239/263; 239/263.3; 239/204; 239/206

[58] Field of Search ..... 239/239, 237, 242, 263, 239/263.3, 579, 586, 203–206

[56] References Cited

U.S. PATENT DOCUMENTS 3,637,139 1/1972 Felix ..... 239/206
3,702,678 11/1972 Hauser ..... 239/239 X
3,758,038 9/1973 Ridgway ..... 239/206

FOREIGN PATENT DOCUMENTS 517746 3/1955 Italy ..... 239/263.3

OTHER PUBLICATIONS

Feecon Instruction Manual, Model OFC, 1/20/78, 29 pages.
Rockwood Systems Corp., Water Powered Monitor Instruction Manual, Jan. 1982, 23 pages.
Walter Kidde, Inc., LO-EX Water Powered Oscillating Monitor brochure, Feb. 1985, 2 pages.
Santa Rosa (Mfg.) Products/ANSUL, Automatic Water Driven Oscillating Monitor Model W-1, Data Sheet, 1 page, ©1985.

*Primary Examiner*—Andres Kashnikow
*Assistant Examiner*—Patrick N. Burkhart
*Attorney, Agent, or Firm*—Thomas S. MacDonald; Alan H. MacPherson; Paul J. Winters

[57] ABSTRACT

A water-driven monitor is provided as a stand-by pre-aimed fire fighting device installed at a fixed location for fire protection of a structure or equipment, such as aircraft, in a hanger structure. The monitor is oscillated by providing a diversion of a minor flow of the water or water/foam to be discharged from the monitor, to reciprocate an annular piston in an annular cylinder in up and down directions. A pair of concentric barrel cams having helical cam tracks therein and a cam ring with attached cam rollers interconnect a fixed base assembly containing the piston and cylinder and a water or water/foam discharge assembly, such that linear piston motion includes oscillatory motion which is transferred to the discharge assembly. A four-way spool valve controls fluid flow to opposite sides of a piston head and a toggle action shuttle actuates the valve spool to reverse the piston movement and the direction of discharge tube oscillation. A series of four torsion springs, two at each end of the shuttle, provide stored spring energy for the toggle action of the shuttle.

20 Claims, 2 Drawing Sheets

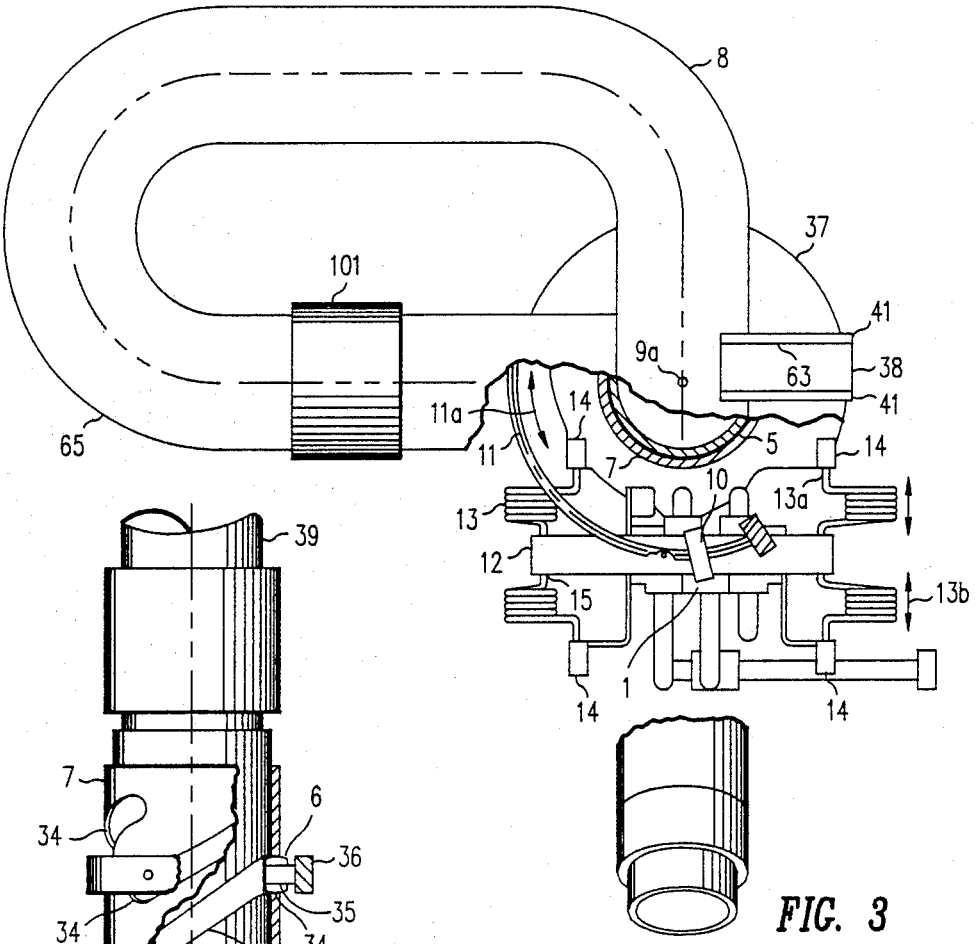
FIG. 3
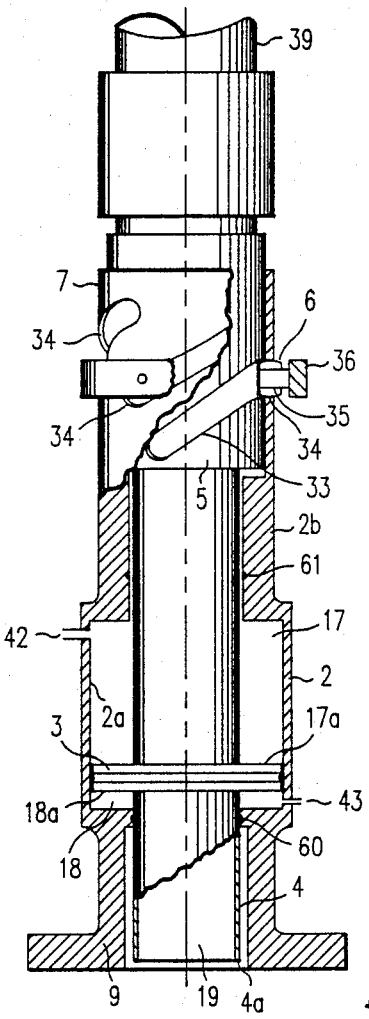
FIG. 2
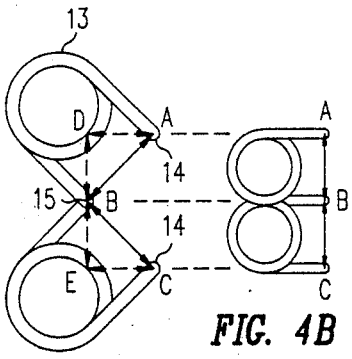
FIG. 4A
FIG. 4B
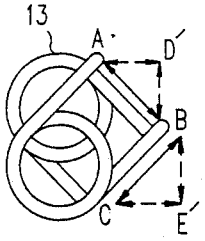
FIG. 4C

WATER-DRIVEN OSCILLATING MONITOR

FIELD OF THE INVENTION

This invention pertains to a fire-fighting monitor for directing water or water-based foam on a fixed hazard in a hazardous location. More particularly the invention is directed to a stand-by water-powered oscillating monitor which is positionable in a pre-aimed mode in aircraft hangers, fueling areas, docks, mills, tankers, drill rigs, or the like for spray flooding an area to be protected.

BACKGROUND OF THE INVENTION

Oscillating turrets or monitors have been developed and sold in the past to automatically distribute foam, water or foam-water over a specific area as determined by an angle of monitor elevation, arc of oscillation, speed of oscillation, and the foam pattern. Both automatic and manual operation has been provided. Such devices are exemplified by the Model OFC of Feecon Corp., Westboro, Mass., incorporating a clutch mechanism and two four-way valves; the Rockwood Monitor of Rockwood Systems, So. Portland, Me., incorporated a rack and pinion and gear drive; the LO-EX monitor of Walter Kidde Inc., Wake Forest, N.C., including a turbine and gear box drive; and the WOT monitor of Santa Rosa Mnfg. Co., San Jose, Calif., including a four-way valve and chain drive.

A feedback actuated four-way valve controlling a cylinder to actuate a second four-way valve is expensive. Four-way valves are invariably used) are the most trouble-prone part of the system, subject to sticking due to corrosion buildup of deposits of waterborne minerals, or waterborne particulate matter. Cylinder-driven rack and pinion gear arrangements are expensive, subject to alignment problems and require periodic lubrication. Cylinder-driven chain and sprocket arrangements are subject to chain stretch and deflection of the cylinder rod due to eccentric loading of the cylinder by the chain. Turbine and gear box drives are susceptible to sticking of the low torque turbine wheel shaft due to various mechanical problems, including corrosion and waterborne mineral deposition.

Most prior art in fluid-driven devices (going back to early steam engines) used feedback from the output of the engine to actuate a four-way valve which reversed flow to a cylinder, which in turn actuated a second four-way valve which reversed flow to the main power cylinder. Such an arrangement is effective but is very expensive.

SUMMARY OF THE INVENTION

The monitor of this invention is intended as a standby device for use with water-based foam systems. It is typically applied to fight fires where the primary hazard has a definite fixed location, allowing pre-aiming of the monitor. The monitor's oscillating motion is powered by a small flow of agent diverted from the main flow.

The invention is directed to a simplified, less expensive, and smaller arrangement to oscillate a water or water/foam discharge tube. A minimum number of mechanical parts is employed. Use of a vertically mounted piston assembly driven by a minor flow of fire-fighting fluid diverted from the main flow and a concentric cam assembly interconnection between a piston assembly fixed base and the discharge tube and the concentricity of the cylinder, piston rod and vertical inlet pipe, allows for oscillation and reciprocation of the discharge tube in a relatively small floor space. This allows the monitor to be positionable close to any wall of a structure being protected and provides a monitor which is less likely to be damaged by movement of equipment in the area being fire protected. The combination of a hollow piston rod with concentric cams achieves a very compact device with very few parts and an extremely short power train.

BRIEF DESCRIPTION OF DRAWINGS

FIG. 2 is a partial cut-away vertical cross-sectional view of the fixed base assembly, the oscillating discharge assembly and the cam interconnection of the assemblies.

FIG. 3 is a partial cut-away top plan view of the base assembly, the discharge assembly and the mechanism producing a toggle action shuttle for control of a four-way valve for reversing the direction of discharge tube oscillation.

FIGS. 4A, 4B and 4C are side views of the torsion springs in successive modes of operation showing the toggle action.

DETAILED DESCRIPTION

Figure 1:
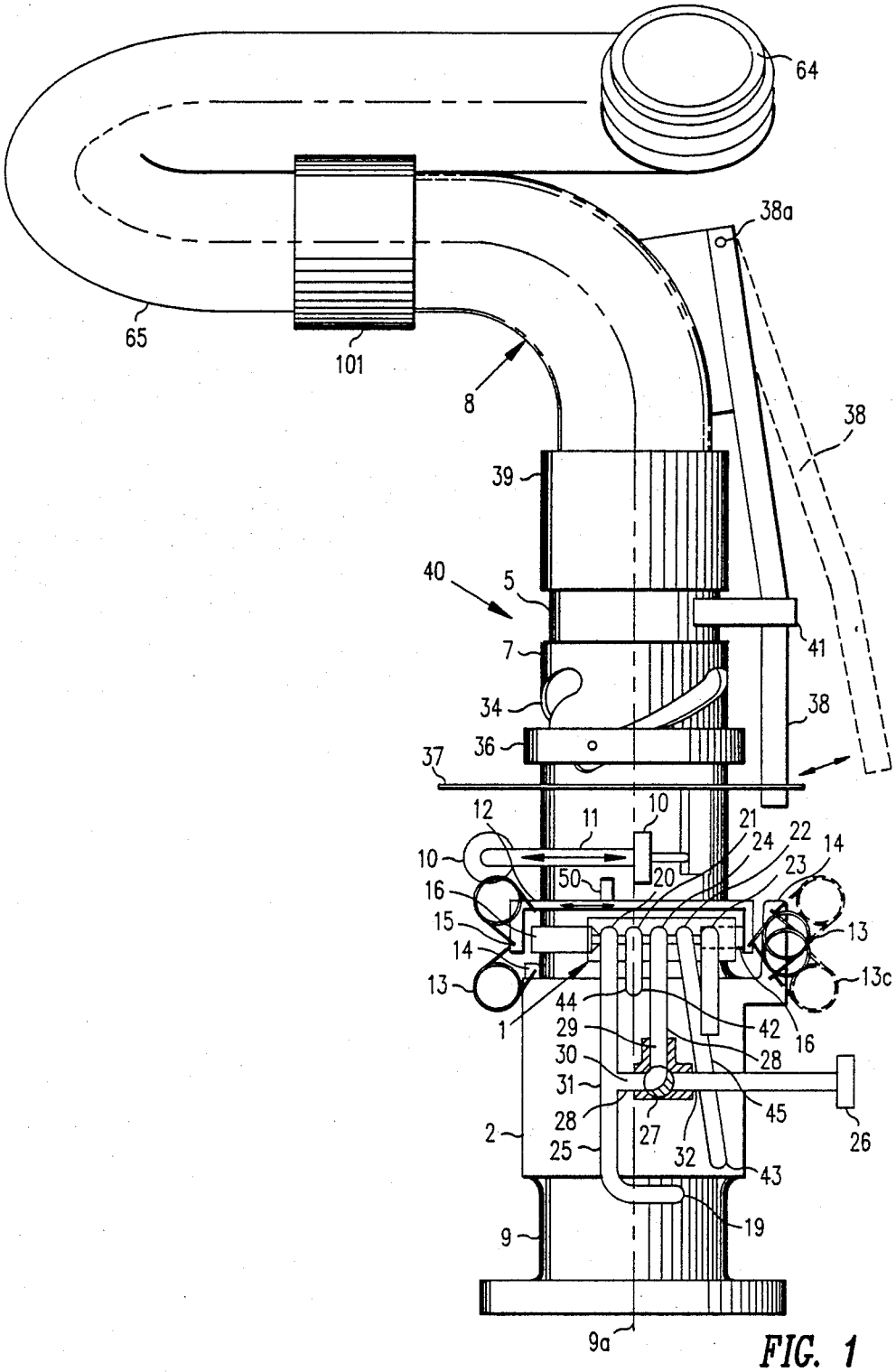
FIG. 1 is a vertical side view of the monitor showing a broken away three-port test valve.

As seen in FIG. 1 pressurized flow of agent ("water" as used herein means water or water/foam) from inlet 9 and through bypass 19 is alternately directed by a reversing four-way valve 1 to one end and then the other end of a vertical annular cylinder 2. This forces a piston 3 (FIG. 2) in the cylinder to reciprocate up and down. A reciprocating hollow piston rod 4, sealed by O-rings 60, 61 positioned in the inner wall periphery of housing or rod cap **2*b* extending above and below the cylinder, is directly connected to a barrel cam 5 having three parallel helical cam tracks 33. Cam rollers 6 engage these tracks, and helical cam tracks 34 in a similar surrounding stationary cam 7. The rolling action of these cam rollers forces the piston 3, piston rod 4, and attached discharge assembly 8** to oscillate as well as reciprocate, with the absolute minimum of mechanical parts. Reciprocation of the discharge assembly due to the cam action is negligible and there is no apparent advantage or detriment by the slight elevational change over the oscillation.

Reversal and angular adjustment of the oscillating motion is accomplished by the action of a pair of set collars 10 (FIG. 1) angularly adjustable by set screw on a curved rod 11 about the monitor's center of rotation **9*a*, actuating a toggle action shuttle 12, which in turn strokes the spool 16 of a four-way valve 1, reversing the direction of water flow to the drive cylinder 2**.

The shuttle 12 is entirely mounted, supported, and guided by four identical torsion springs 13. These springs are wound with their coils axially spaced, allowing them to be loaded in compression as well as torsion. Both free tangential wire ends **13*a* are bent parallel to the centerline of the coil to allow them to be pivotally mounted to mounts 14. The orientation of these springs with respect to the shuttle and to their fixed mountings 14** is such that:

(1) the two springs at each end of the shuttle are loaded in compression, opposing each other to hold the shuttle in a centered stable lateral position at any and all longitudinal positions throughout the travel of the shuttle, i.e., the axial compressing forces are balanced at all times as shown by the double arrows 13b, and (2) the vertical force components of the torsional loading of the two springs at each end of the shuttle oppose each other, holding the shuttle at a centered, stable vertical height at any and all longitudinal positions throughout the travel.

These same vertical forces from the springs at one end, being laterally spaced, impart a twisting moment about the longitudinal centerline of the shuttle, which is exactly opposed and balanced by a like moment of opposite direction imparted by the springs at the other end. This holds the shuttle in a stable rotational orientation about the longitudinal centerline of the shuttle throughout its travel.

At the center of the travel of shuttle 12, the centerlines of the pivotal mountings 15 of the springs in the shuttle lie in a vertical plane through the fixed pivotal mountings 14 at the ends of the shuttle which will eliminate any horizontal force component (FIG. 4B). This is an unstable position. The springs are at this point at their maximum torsional load. To either side of this position, the horizontal components of the "torsional" loads on the springs are all additive in a direction away from center.

The above is illustrated for three successive modes of spring action in FIG. 4A, 4B and 4C. In FIG. 4A the lefthand springs of FIG. 3 are shown at the left end of the stroke where the vertical force components DB and BE cancel out at all times and the horizontal components DA and EC push the shuttle to the left with the springs as shown. In FIG. 4B an intermediate center position of the shuttle movement is shown with no horizontal forces present and with the vertical forces AB and BC balanced. In FIG. 4C which illustrates the right end of the stroke as on the left side of FIG. 3, the horizontal forces AD′ and CE′ push the shuttle to the right while the vertical forces D′B and BE′ are balanced. This provides a very strong "toggle" action. The torsion springs are shown in phantom lines at 13c whereat they are expanded outwardly when they all move or pivot during the shuttle cycle.

The shuttle is moved horizontally against the spring force by movement of the set collars 10 adjustably mounted on the circularly curved adjustment rod 11. This adjustment rod is mounted concentric with the center of oscillation 9a of the monitor and oscillates with the adjustment plate 37 and the oscillating "upper half" 8 of the monitor. The set collar as it rotates strikes a tab 50 extending from the shuttle and moves the shuttle to the center position, at which point, the spring force now begins to act in the same direction on the shuttle as it is already moving, resulting in an unloading of the energy stored in the springs and a sudden toggle action, moving the shuttle ahead of the driving set collar.

The shuttle 12 contacts the valve spool 16 somewhat past the shuttle's center of travel, by which point a substantial horizontal force component exists. The shuttle has also already been accelerated to an appreciable velocity, allowing it to impact the end of the spool. The resulting movement of the valve spool is rapid and not dependent on movement of the set collar to carry it through its stroke. This arrangement eliminates any tendency for the monitor to "hang up" at the center of valve travel.

The effective areas upon which water pressure acts are:

(1) upper cylinder annular area 17a between tubular piston rod 4 and cylinder wall 2a (18.87 in.$^2$ on current configuration);

(2) lower cylinder annular area 18a between tubular rod 4 and cylinder wall 2a (equal to 1)); and (3) lower end a of tubular rod 4 (9.40 in.$^2$, equal to approximately one-half of 1)).

Pressure within the flow passage 19 of the monitor provides the diversion of a minor flow of pressurized (by water main pressure) water or water/foam in inlet 9 and always acts on the end 4a of the rod. This is not a controllable force.

The piston 3 is forced downwardly in the drive cylinder 2 by connecting the upper cylinder 17 by passage 42 to the flow passage 19 and venting the lower cylinder 18 to atmosphere through passage 43. Pressure in the upper cylinder, acting on twice the area of the end of the tubular rod 4, forces the piston 3 down. To reverse the stroke, the upper and lower cylinders are both connected by passages 42, 43, respectively to the flow passage 19 allowing water to flow freely from the upper cylinder to the lower cylinder, as the piston and rod assembly is forced up by pressure in the flow passage acting on the end of the rod. Thus, it will be seen that the upper cylinder 17 is always pressurized, and reversing of piston movement is achieved by simply venting or pressurizing the lower cylinder 18 through passage 43.

Physical accomplishment of the above porting sequence is done with a five-port, four-way directional valve 1 connected in FIG. 1 as follows:

(1) connect vent valve port 20 for the upper cylinder 17 to the pressurized flow passage 19 with line 25.

(2) & (3) both valve "cylinder" ports 21 and 22 are connected to their respective upper and lower cylinders 17 and 18 at cylinder ports 42 and 43 with lines 44 and 45.

(4) vent port 23 for lower cylinder extends to atmosphere.

(5) pressure port 24 is connected with line 28 to a tee 31 in the line 25 between the upper cylinder vent port 20 and the pressurized flow passage 19.

To allow for a "test" connection 26, for use when the flow passage is not pressurized, a three-port directional valve 27 is installed in the "pressure line" 28. The middle port 29 of the three-port valve is connected to the pressure port 24 of the five-port valve. One of the other ports 30 is connected by the mentioned tee 31 to both the upper cylinder vent port 20 and the pressurized flow passage 19. The remaining port 32 of the three-port valve is connected to an external pressure source 26, such as a garden hose water supply. In the "run" position (shown), this three-port valve 27 does not alter the plumbing scheme presented. In the "test" position, it allows the upper cylinder 17 to vent to the empty flow passage 19 resulting in a system where motion results only from pressure in the upper and lower cylinders 17 and 18.

As seen in FIG. 2, the reciprocating motion of the piston-rod assembly 3 and 4 is converted to oscillating motion through use of a pair of helical "barrel" cams 5 and 7. These cams each have three equally spaced helical grooves 33 and 34 of the same hand but with a slightly differing helix angle. In a typical application the helix angle of the first set of tracks on inner cam 5 may be about 29° and the helix angle on outer cam 7 may be about 21°43'. Three crowned cam rollers 6 on the respective barrel cams each engage an inner slot 33 and one outer slot 34. All three rollers are held in place by axles 35 protruding inwardly from a surrounding cam ring 36. On the upward stroke, the rollers 6 contact and roll against the lower surface of the grooves 33 on the inner cam 5 and the upper surface of the grooves 34 on the outer cam 7. A pure rolling action results. On the downward stroke, the action reverses. The rollers 6 contact the upper surface of the inner cam groove 33 and the lower surface Of the outer cam groove 34. Differing cam helix angles are used to insure that at any mid-stroke position, the rollers 6 will be properly "timed" with respect to the relative axial position of the cams; that is they will be at the appropriate vertical position to allow pure rolling for the full stroke in both directions. It is to be noted that if the helix angles were identical, the cams 6 and the attendant cam ring 36 could, at mid-stroke for instance, "fall" down to the bottom of both grooves 33 and 34. Subsequent upward motion of the inner cam 5 would result in sliding of the rollers 6 on the cam surfaces, as the rollers would all be pocketed in the lower ends of the outer cam track 34 and could not roll thereon.

The cam action results in a combination of oscillation and vertical reciprocation (or helical motion) imparted to the discharge assembly 8 ("upper half") including a discharge tube 65 and nozzle attach collar 64. Angular direction feedback from the discharge assembly is required to cause the directional valve 1 to reverse when the upper half 8 reaches a predetermined angular position at either end of the desired stroke. For this purpose, an adjustment plate 37 including the curved adjustment rod 11 and set collars 10 is provided, which can oscillate but not translate vertically. The plate 37 is rotationally loose or mounted to stationary cam 7 and is slidably engaged and driven by a latch 38, movable about pivot **38*a* and insertable in a notch (not shown) in plate 37, driving plate 37 to move with the discharge assembly 8. A tab 50 on the shuttle is contacted by the collars 10 to initiate shuttle reversal. In FIG. 1 the short double arrows represent the linear shuttle movement while the long double arrows 11*a* (FIG. 3) represent the rotational movement of plate 37, rod 11 and set collars 10**.

A rotatable, sealed, ball-bearing joint 39 connects the upper half 8 and lower half 40, allowing manual operation of the upper half (angularly from side to side). Angular drive of the discharge assembly 8 from the lower half 40 is by means of connection engagement of the latch 38 with a slot 63 between a pair of lugs 41 fixedly connected to the top of the inner cam 5 which is part of the assembly lower half 40. The latch can be disengaged and pivoted or vertically slidable from both the adjustment plate 37 and the drive lugs 41 on the lower assembly half to allow free movement of the upper assembly half 8 (as shown in phantom). The discharge tube assembly 8 can then be freely rotated in bearing 39.

Flow pattern (straight stream versus a "fog" pattern of various cone or fan widths) is a function of the setting of any of the many usable existing auxiliary fire-fighting nozzles which are not a part of this invention. Nozzle elevation ( or inclination) is changed by rotating bent tube 65 with respect to elbow 8 at joint 101. A clamping sector plate (not shown) attached to elbow 8 is clamped by a caliper and clamp screw attached to bent tube 65. This is a conventional means used in the industry and is not novel.

The above description of the preferred embodiment of this invention is intended to be illustrative and not limiting Other embodiments of this invention will be obvious to those skilled in the art in view of the above disclosure.

I claim:

1. A water-driven oscillating monitor comprising:

a fixed base assembly and an oscillating and reciprocating water discharge assembly;

said base assembly comprising a housing having an internal vertical annular cylinder, a vertical hollow piston head movable vertically and rotationally in said cylinder, a water flow hollow piston rod extending through said housing and cylinder and fixedly connected to said piston head, and a first barrel cam connected to an upper end of said piston rod;

a second barrel cam connected to said housing and surrounding said first barrel cam, each of said barrel cams having at least one helical cam track, at least one cam roller engaging a helical track in each of said barrel cams, and means for retaining said at least one roller in said track in each of said barrel cams;

said discharge assembly comprising a water discharge tube in flow communication with said hollow piston rod;

means for connecting said discharge assembly to said first barrel cam; and means for vertically reciprocating said piston rod and piston head in said annular cylinder, wherein said at least one cam roller rolls in said tracks to oscillate and reciprocate said discharge tube.

2. The monitor of claim 1 in which said at least one helical cam track in each barrel cam comprise three parallel helical cam tracks in each barrel cam.

3. The monitor of claim 2 in which said cam tracks in the respective barrel cams are helical grooves of the same hand but with a differing helix angle.

4. The monitor of claim 1 including an adjustment plate on said second barrel cam movable in oscillation, said plate including means for adjusting the oscillation arc of said first barrel cam and said discharge tube.

5. The monitor of claim 4 wherein said means for adjusting includes a curved adjustment rod and a pair of set collars.

6. The monitor of claim 1 wherein said means for connecting includes a latch connected to said discharge tube, and a pair of spaced lugs extending from and fixed to said first barrel cam, said latch being engageable with said pair of lugs to oscillate said discharge tube and being disengageable from said lugs to allows free oscillatory movement of said discharge tube.

7. The monitor of claim 6 further comprising an oscillating arc adjustment plate on said second barrel cam and wherein said latch is engageable with said lugs and said adjustment plate.

8. The monitor of claim 1 wherein said means for vertically reciprocating said piston rod comprises a fluid flow stream, a four-way spool valve in operable connection to said fluid flow stream and to opposed sides of said piston head in said annular cylinder, a toggle action shuttle, means including torsion springs connected to said housing for mounting, supporting and guiding said shuttle, and a valve spool in said valve, said spool being translatingly movable in said valve by movement of said shuttle to reverse flow of said fluid flow stream to an opposite side of said piston head and reverse the oscillating and reciprocating direction of said discharge assembly.

9. The monitor of claim 8 further including an oscillating arc adjustment plate on said second barrel cam, a pair of set collars, and wherein said shuttle is moved against spring action of said torsion springs alternately by one and then the other of said collars to a spool reversing position.

10. The monitor of claim 9 including a plurality of pairs of torsion springs connected between said shuttle and said housing, wherein motion of said shuttle by said set collar past the shuttle center of travel releases stored energy in at least one of said torsion springs to accelerate motion of said shuttle and to provide rapid movement of said valve spool, such that said discharge assembly does not hang up at the center of valve spool travel.

11. The monitor of claim 1 wherein said means for vertically reciprocating said piston rod and piston head in said annular cylinder, includes a four-way valve, and means for diverting a minor flow of water passing through said hollow piston rod, to said valve for reversing the direction of reciprocation of said piston rod and piston head.

12. The monitor of claim 1 further including means for reversing the direction of reciprocation of said piston rod and piston head.

13. The monitor of claim 12 in which said means for reversing includes a four-way spool valve in operational connection to opposite sides of said piston head.

14. The monitor of claim 13 further including a toggle action movable shuttle reversing flow of water from one side to another side of said piston head in said annular cylinder.

15. The monitor of claim 14 further including two torsion springs at each end of said shuttle loaded in compression opposing each other for holding said shuttle in a stable lateral, vertical, and rotational position along longitudinal positions over the travel of said shuttle.

16. The monitor of claim 13 including an auxiliary three-port valve connected to an external pressure source, said three-port valve being connectable to a port of said four-way valve for oscillating and reciprocating said discharge assembly in a test mode without flow of water through said hollow piston rod to said discharge tube.

17. A water-driven oscillating monitor comprising a fixed base assembly and an oscillating and reciprocating water discharge assembly in operating assemblage therewith; said base assembly including an annular cylinder, an annular piston head reciprocably slidable in said cylinder, a water flow hollow piston rod connected to said piston head; said discharge assembly including a discharge tube in water flow communication with a central passage within said annular piston head and a central passage within said hollow piston rod;

means for converting said reciprocable movement of said piston to oscillatory movement; and wherein said means for converting comprises cam means for interconnecting and oscillating said discharge assembly with respect to said base assembly, said cam means including a cam barrel extending around and interconnected with said hollow piston rod and operable by movement of said piston head in said cylinder responsive to a diversion of a minor flow of water from said central passage to a valve, said valve being operable for reversing the movement of said piston head in said cylinder.

18. A water-driven oscillating monitor comprising a fixed base assembly and an oscillating and reciprocating water discharge assembly in operating assemblage therewith; said base assembly including an annular cylinder, an annular piston head slidable in said cylinder, a water flow hollow piston rod connected to said piston head; said discharge assembly including a discharge tube in water flow communication with a central passage within said annular piston head and a central passage within said hollow piston rod;

cam means for interconnecting and oscillating said discharge assembly with respect to said base assembly, said cam means being operable by movement of said piston head in said cylinder responsive to a diversion of a minor flow of water from said central passage to a valve for reversing the movement of said piston head in said cylinder; and in which said cam means includes a first barrel cam connected to said piston rod, a second barrel cam connected to said fixed base assembly, at least one helical cam track in each of said barrel cams, and a cam ring and roller engaging said cam tracks such that movement of said piston head oscillates said second barrel cam and said discharge tube.

19. The monitor of claim 18 further including means in said valve for changing the direction of movement of said piston head by said diverted water flow and means including a movable shuttle for operating said valve in response to fixed set points positioned around said fixed base assembly and rotatable with said discharge tube oscillation.

20. The monitor of claim 19 including torsion springs extending between each opposite end of said shuttle and said base assembly for mounting, supporting and guiding movement of said shuttle to actuate said valve.

* * * * *